US005695695A

United States Patent [19]

Steinau et al.

[11] Patent Number: 5,695,695

[45] Date of Patent: Dec. 9, 1997

[54] MANUFACTURE OF POLYMER FIBRIDS

[75] Inventors: Peter Steinau, Mainz; Dieter Jungert, Toenisvorst; Volker Mai, Krefeld; Birgitta Meier, Moers; Eckehard Pohl, Krefeld, all of Germany

[73] Assignee: Messer Griesheim Gmbh, Frankfurt, Germany

[21] Appl. No.: 561,303

[22] Filed: Nov. 21, 1995

[30] Foreign Application Priority Data

Nov. 24, 1994 [DE] Germany ..... 44 41 801.9

[51] Int. Cl.[6] ..... B01J 2/06

[52] U.S. Cl. ..... 264/11

[58] Field of Search ..... 264/11

[56] References Cited

U.S. PATENT DOCUMENTS

| | | | |
|---|---|---|---|
| 2,999,788 | 9/1961 | Morgan . | |
| 4,013,744 | 3/1977 | Kuerten et al. | 264/11 |
| 4,091,058 | 5/1978 | Sander et al. | 264/11 |
| 4,112,029 | 9/1978 | Sander et al. | 264/11 |
| 4,128,614 | 12/1978 | Gilbert | 264/205 |
| 4,210,615 | 7/1980 | Engler et al. | 264/11 |
| 4,219,512 | 8/1980 | Sinn et al. | 264/11 |
| 4,224,259 | 9/1980 | Sander et al. | 264/11 |
| 4,340,442 | 7/1982 | Hart et al. | 162/146 |
| 4,493,751 | 1/1985 | Cherdron et al. | 264/14 |
| 5,482,773 | 1/1996 | Bair | 264/11 |

FOREIGN PATENT DOCUMENTS

| | | |
|---|---|---|
| 0053188 | 6/1982 | European Pat. Off. . |
| 1934541 | 1/1971 | Germany . |

*Primary Examiner*—Mary Lynn Theisen

*Attorney, Agent, or Firm*—Connolly & Hutz

[57] ABSTRACT

The invention enables production of polymer fibrids comprising a polyester which is injected as a low-viscosity jet into a shear field formed by liquid jets, torn apart by the liquid jets and formed into fibrids having a fibril length of from 0.1 to 5 mm by cooling, crystallization and orientation.

12 Claims, No Drawings

MANUFACTURE OF POLYMER FIBRIDS

BACKGROUND OF THE INVENTION

Polymer fibrids are pure fibers having an irregular fiber morphology which are not spinnable and cannot be further divided. The are composed of the crystallites and any amorphous fiber components and represent the smallest fiber units. The possible uses of these fibers have increased greatly in recent years. Apart from the conventional fields of use, such as in paper manufacture, further markets can be opened up by the recyclability of the products which is gaining increasing importance.

Polymer fibrids of polyethylene (HDPE, LLDPE) and polypropylene (PP) are already known. The polymer fibrids are produced in the flash spinning process. In this process, the polymers are emulsified in a water/solvent mixture under pressure and with heating and the emulsion is sprayed into a vacuum. This causes the solvent to evaporate, the temperature drops greatly and the polymer is converted, with crystallization, into fibrids.

A prerequisite for this is a certain minimum degree of crystallization and certain minimum crystallization rates of the polymer. Only polymers which are economically and technically soluble in normally available solvents, for example aliphatic hydrocarbons, are suitable for the spinning process. The process results in products which have to be subjected to further treatment.

Polymer fibrids of polyacrylonitrile (PAN) or polyaromatics and cellulose acetate are produced from prefabricated splittable fibers. The route for producing the fibrids is via films or spun fibers. The film is extruded, cut, drawn and mechanically fibrillated. Under the action of heat, the film is drawn to a multiple of its length. The orientation of the molecules has to be carried out at a temperature below the crystallite melting point. A significant increase in the tensile strength and a decrease in the elongation at break in the draw direction occur. Spun fibers are specially highly drawn (high modulus) to increase the tendency to split.

The use of the fibrids depends essentially on the raw material properties of the starting polymers. In many cases, necessitated by the process, a certain hydrophilicity is a prerequisite for the possible uses. To open up new possible applications or to provide existing applications with new properties which increase the product value, fibrids of other polymers, particularly polyesters, would be desirable. Attempts to produce fibrids based on polyester by the processes described above did not lead to success. Mechanical fibrillation is ruled out owing to the crystallization of the film during its production in a separate step (fixing), so that, because of its crystallized state, it can no longer become splittable, while the spinning process cannot be economically carried out due to lack of suitable solvents.

SUMMARY OF THE INVENTION

It is an object of the invention to provide new polymer fibrids.

This object is achieved by means of polymer fibrids having the features being of a length of from 0.1 to 5 mm as a result of injecting polyesters as a low-viscosity jet into a shear field formed by liquid jets. The polyester is torn apart by the liquid jets and formed into the fibrids by cooling, a crystallization and orientation.

DETAILED DESCRIPTION

A process has surprisingly been found, by means of which fibrids based on polyester, preferably of a polyphthalate ester, can be produced for the first time. The fibrids have the desired fibril finenesses and shortness of from 0.1 to 5 mm in production.

The fibrids of the invention comprise a polyester which is injected as a low-viscosity jet into a shear field formed by liquid jets, torn apart by the liquid jets and formed into fibrids by cooling, crystallization and orientation. The fibrids based on polyester which are produced have a specific surface area of from 1 to 10 $m^2/g$ and are dispersible in water without pretreatment. The melting point lies in the range 200°–260° C. with good long-term heat resistance.

The process of the invention for producing fibrids based on thermoplastic polyesters starts out from the idea of heating the polyester at temperatures below its decomposition temperature between 100° C. and 450° C., in particular between 250° C. and 400° C., to give a viscous mass and tearing it apart. The polyester jet has, after it is heated, a viscosity below 200 pascal.second, preferably below 100 Pa.s. The low-viscosity polyester is, under a pressure of between 100 and 1000 bar, injected at high velocity in a jet free into an energy-rich shear field. The shear field is formed by liquid or gaseous spray jets which are directed at a center and impinge on the polyester jet with high kinetic energy at pressures between 100 and 1000 bar. The spray jets preferably comprise low-temperature liquified gases such as the inert gases nitrogen and argon. Water too can be used at pressures above 100 bar. The polyester torn apart in the shear field comprising liquid nitrogen jets forms fibrids on cooling, crystallization and orientation.

The polyester melted in an extruder is sprayed free at a temperature of from 100° C. to 450° C. into the shear field through a nozzle which determines the polyester jet geometry. The spray pressure is at least 100 bar and, in terms of its maximum pressure of, for example, 1000 bar, is restricted only by technical and economical limits. There, the polyester jet immediately reaches the center of the shear field produced by a nozzle system. The nozzle system consists of flat jet or full jet nozzles which are arranged at an angle of from 30° to 150° to the polyester jet. The polyester jet is here torn apart by the energy of the shear field and at the same time greatly cooled. The kinetic energy of the atomization medium, preferably a liquified inert gas, in particular nitrogen, and the great temperature difference of up to 650 K. effect such a strong stressing of the polyester that it disintegrates into fibrids. The fibrids formed collect at the bottom of the reaction chamber. They can be taken out through an opening in the reaction chamber. The nitrogen gas formed is conveyed through a filter and a cyclone via a fan into a stack and thus into the open or into a recovery circuit. The nitrogen required by the nozzle system of the shear field reaches the nozzle system in the liquid state and under high pressure via a high-pressure pump from an insulator tank.

The fibrids produced have significant variations in density and length of the individual fibrils and have a free surface area below that of products produced via an emulsion or by surface-dissolution. They have more covered surfaces. The controllability of the fibril sizes is significantly extended by the process of the invention, so that a very fine pulp can be achieved.

EXAMPLE A

Polyalkylene terephthalates (PTPs) belong to the group of polyphthalate esters. Two different types of polyalkylene terephthalates are polyethylene terephthalate (PET) and polybutylene terephthalate (PBT). At room temperature, PET and PBT are hard, stiff, partially crystalline polymers which have good impact toughness even at low temperatures and have good sliding and abrasion behavior. PTP has very low viscosity at higher processing temperatures.

An extremely easy-flowing PTP type from Hoechst AG (Celanex) was divided into fibrids in a shear field using low-temperature liquified nitrogen. Celanex is a partially crystalline, thermoplastic polyester type based on PBT. PBT is produced by melt polycondensation of dimethyl terephthalate with 1,4-butanediol and has the following chemical formula:

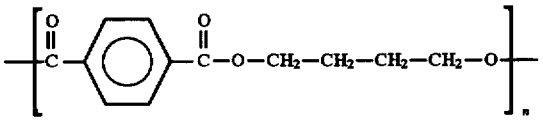

The physical properties of Celanex are shown below:

| | |
|---|---|
| Trade name: | Celanex |
| Grade: | 2000-2 |
| Manufacturer: | Hoechst AG |
| Melt index MVI 250/2: | 65 $cm^3$/10 min |
| Density: | 1.30 $g/cm^3$ |
| Crystallite melting range: | 200–225° C. |

Celanex was broken up under the experimental conditions given in the table:

| Test material | PBT Celanex 2000 |
|---|---|
| Temperature | |
| Nozzle | 340° C. |
| Zone 1 | 350° C. |
| Zone 2 | 300° C. |
| Zone 3 | 200° C. |
| Nitrogen nozzle | Flat jet 1.02 mm |
| Polymer nozzle | Full jet 0.47 mm |
| Nitrogen pressure | 250 bar |
| Polymer pressure | 180 bar |
| Spray time | 4–5 sec |

Sieve analysis:

| Mesh opening in μm | PBT |
|---|---|
| 800 | 93.6% |
| 630 | 90.4% |
| 400 | 77.6% |
| 250 | 49.6% |

The experiments result in fibrids having a (very) fine structure with a lustrous character.

EXAMPLE B

A low-viscosity PTP grade from Hoechst AG (RT 40) was broken up into fibrids in a shear field using low-temperature liquified nitrogen. RT 40 is a partially crystalline, thermoplastic polyester type based on PET. PET is produced by melt polycondensation of dicarboxylic acids and dialcohols (=terephthalate acid+ethylene glycol=PET; RT 40 also contains a proportion of isophthalic acid) and has the following formula:

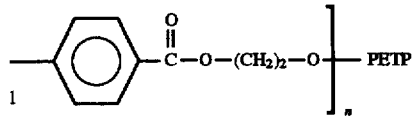

The physical properties of RT 40 are shown below:

| | |
|---|---|
| Trade name: | Impet |
| Grade: | RT 40 |
| Manufacturer: | Hoechst AG |
| Density: | 1.3 $g/cm^3$ |
| Crystallite melting range: | 250–260° C. |

Parameters:

| Test material | Acid basis: terephthalic and isophthalic acid PET RT 40 |
|---|---|
| Temperature | |
| Nozzle | 340° C. |
| Zone 1 | 350° C. |
| Zone 2 | 310° C. |
| Zone 3 | 200° C. |
| Nitrogen nozzle | Flat jet 1.02 mm |
| Polymer nozzle | Full jet 0.47 mm |
| Nitrogen pressure | 250 bar |
| Polymer pressure | 180 bar |
| Spray time | 4–5 sec |

Sieve analysis:

| Mesh opening in μm | PET |
|---|---|
| 800 | 100% |
| 630 | 98.4% |
| 400 | 95.2% |
| 250 | 74.4% |

The experiments result in fibrids having fiber lengths of ≦5 mm and a high temperature resistance. In addition, they have an extremely fine fiber structure with a lustrous character and have a very low proportion of film and melt particles.

What is claimed is:

1. A process for forming polymer fibrids comprising injecting polyesters as a low-viscosity jet into a shear field formed by liquid jets, tearing apart the polyester by the liquid jets, and forming the polyester into fibrids having a fibril length of from 0.1 to 5 mm by cooling, a crystallization and orientation.

2. The process of claim 1 wherein the polymer fibrids are produced from a polyester jet having a viscosity below 200 Pa.s.

3. The process of claim 2 wherein the viscosity is below 100 Pa.s.

4. The process of claim 1 wherein the polyester is a polyterephthalate ester.

5. The process of claim 1 wherein the polyester is a polyalkylene terephthalate.

6. The process of claim 1 wherein the polyester is a polybutylene terephthalate.

7. The process of claim 1 wherein the liquid jets are formed from low-temperature liquified gases selected from the group consisting of nitrogen and argon.

8. The process of claim 1 wherein the liquid jets are sprayed at a pressure of between 10 and 600 bar onto the polyester jet.

9. In a process for forming polymer fibrids wherein the polymer fibrids are sprayed at a temperature below their decomposition temperature between 100° C. and 450° C. and at a pressure between 100 and 1000 bar into the shear field formed by liquid jets and are torn apart using liquid jets.

10. The process of claim 9 wherein the liquid jets are formed from low-temperature liquified gases selected from the group consisting of nitrogen and argon.

11. The process of claim 10 wherein the liquid jets are sprayed at a pressure of between 10 and 600 bar onto the polyester jet.

12. The process of claim 9 wherein the liquid jets are sprayed at a pressure of between 10 and 600 bar onto the polyester jet.

* * * * *